US008490456B2

(12) United States Patent
Wang et al.

(10) Patent No.: US 8,490,456 B2
(45) Date of Patent: Jul. 23, 2013

(54) DRAW DIE AND METHOD OF MANUFACTURING SAME

(75) Inventors: Amber Wang, Canton, MI (US); Weilong Hu, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 1364 days.

(21) Appl. No.: 12/055,257

(22) Filed: Mar. 25, 2008

(65) Prior Publication Data

US 2009/0241628 A1 Oct. 1, 2009

(51) Int. Cl.

| | |
|---|---|
| ***B21D 22/00*** | (2006.01) |
| ***B21D 22/21*** | (2006.01) |
| ***B21D 37/10*** | (2006.01) |
| ***B21J 13/02*** | (2006.01) |
| ***B21J 13/04*** | (2006.01) |

(52) U.S. Cl.
USPC ..... 72/350; 72/456; 72/448

(58) Field of Classification Search
USPC ..... 72/455, 456, 350, 482.6–482.9, 482.93–482.94, 446, 448
See application file for complete search history.

(56) References Cited

U.S. PATENT DOCUMENTS

| | | | | |
|---|---|---|---|---|
| 2,912,730 | A * | 11/1959 | Bauer | 403/378 |
| 6,311,597 | B1 * | 11/2001 | Schroth et al. | 72/456 |
| 7,097,033 | B2 * | 8/2006 | Koefelda et al. | 206/427 |
| 7,578,223 | B2 * | 8/2009 | Bliss | 72/446 |
| 2002/0095968 | A1 * | 7/2002 | Matsunaga | 72/350 |
| 2008/0098789 | A1 * | 5/2008 | Hori et al. | 72/350 |
| 2008/0202190 | A1 * | 8/2008 | Boersma | 72/343 |

* cited by examiner

*Primary Examiner* — Dana Ross
*Assistant Examiner* — Mohammad I Yusuf
(74) *Attorney, Agent, or Firm* — Tung & Associates; Raymond L. Coppielle

(57) ABSTRACT

The embodiment relates generally to a stamping or draw die used for forming a workpiece into a part or component using a first die shoe, a second die shoe and a punch wherein the punch draws the material into a cavity located in the second die shoe. The force is generated during the forming operation are often unbalanced which generates an uneven stress distribution on the component of the die assembly. By varying the position and angle of the guide surfaces located on the punch, first die shoe and second die shoe the stress can be distributed across a greater area of the respective die assembly component to reduce stress concentrations in a localized area and correspondingly reduce the potential for die failure.

7 Claims, 8 Drawing Sheets

FIG. 3
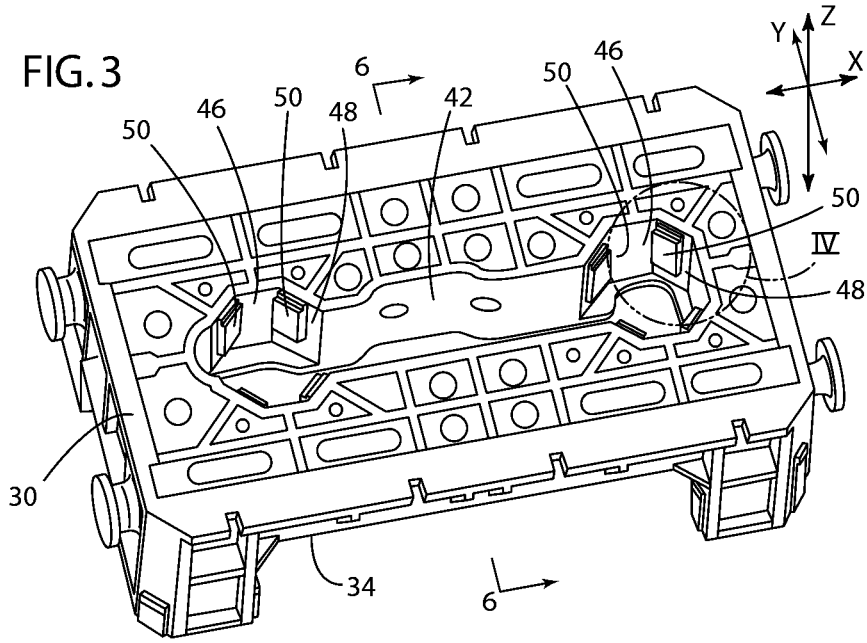
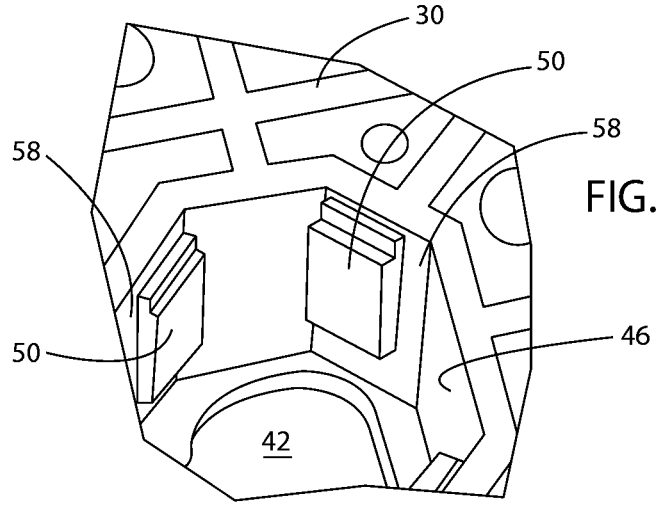
FIG. 4

FIG. 11
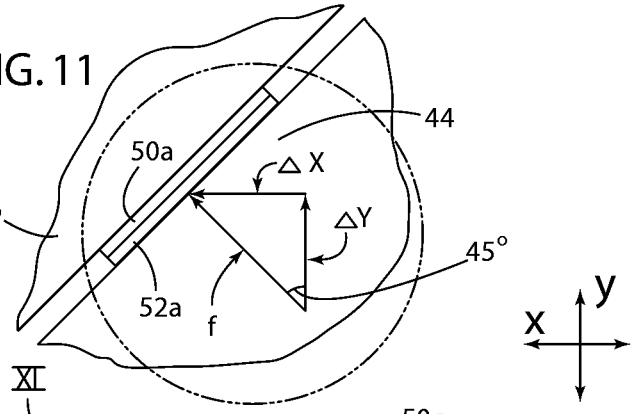
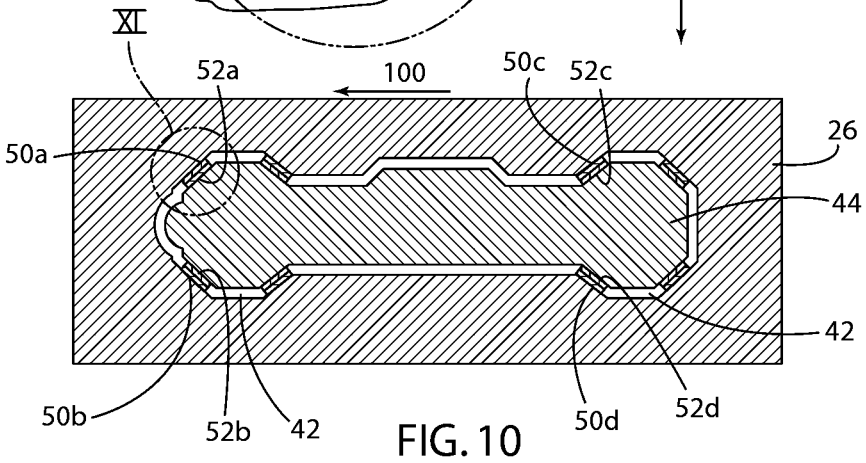
FIG. 10
FIG. 13
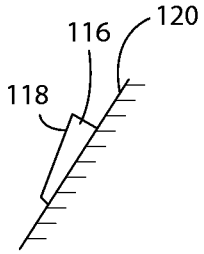

DRAW DIE AND METHOD OF MANUFACTURING SAME

CROSS-REFERENCE TO RELATED APPLICATIONS

Not Applicable

BACKGROUND

1. Field of the Embodiment

The embodiment relates generally to a stamping die and more particularly to a method for designing a stamping die and a stamping die for use in producing sheet metal parts.

2. Description of Related Art

Stamping dies are used for producing sheet metal parts. A toggle draw die is one type of draw die assembly used to form sheet metal, particularly when the metal part has a complex geometry and requires deep drawing. Toggle draw dies account for approximately 40% of all stamping dies. A toggle draw die assembly usually includes 3 main components, often referred to as a draw punch, a die cavity and a binder ring. It may include other components such as die shoes, guideposts, adaptor plates and wear plates. Each component has a particular function while at the same time interacting with the other components. For example, one function of the binder ring is to control the metal flow by applying pressure to the sheet metal lying between the binder and the lower die cavity during the forming process. In addition, the binder ring also serves as a guide for the punch.

During a stamping cycle a draw die assembly often undergoes complex loading conditions, particularly in cases where an unbalanced forming force exists. An unbalanced forming force typically occurs and is often significant when the part is non-symmetrical, which holds true for most parts. An unbalanced forming force occurring during the forming operation can cause the punch to deviate from its vertical position and interact with the binder ring in the lateral direction thus creating a lateral force on the binder ring. Similarly, the binder ring and the lower cavity may also experience contacting interaction in the form of a lateral force.

Interacting lateral forces occurring between the various components caused by unstable and undesirable punch motion, can create failure modes for the die structure including cracking or breaking of the die and excessive die deformation. When die cracking occurs, dies have to be removed from production for repair, if repairable. The die may be reconstructed or a new die must be designed and built if the old die or component thereof is not repairable, a process which normally takes months to complete. The new or repaired die must be tried out again before resuming production. Manufacturing losses resulting from such failures, including lost production and market share can be costly. For example, in addition to a manufacturer incurring assembly plant down time and corresponding lost production costs, the manufacturer will also incur additional costs associated with any redesign, repair and rebuild of the die assembly.

Lateral forces occurring between the various components can also lead to excessive die deformation. Excessive die deformation can cause issues with stamping quality as die deformation often leads to poor control of the binder pressure and consequently poor control of the metal flow.

Since die design is primarily based on generic standards and prior experience of the designer, the performance expectations of many die designs are unknown. Some are under designed while others are over designed. This can lead to prolonged die tryout and setup which can delay production along with increasing costs due to die failure. Accordingly, there are many challenges related to die engineering and design regarding die cost reduction and performance improvement.

SUMMARY

The embodiment is a draw die and method of manufacturing a draw die wherein the draw die is used for forming a metal sheet or workpiece into a part or component. The draw die includes a die assembly having a first die shoe and a second die shoe. The die shoes operative to move between a first, open position and a second, closed position. A punch extending through an aperture in the first die shoe engages the workpiece and draws the workpiece into a die cavity located in the second die shoe. The first die shoe includes at least one heel member and the second die shoe includes at least one socket wherein the heel member is disposed within the socket when the die assembly is placed in the second, closed position. The heel and socket having complementary configurations whereby the socket and heel cooperate to prevent movement of the first die shoe with respect to the second die shoe during the forming process. The embodiment further includes providing a plurality of guide surfaces on the respective heel and socket wherein the guide surfaces are orientated such that they are at an angle with respect to the longitudinal axis and the lateral axis of the die assembly.

The embodiment further includes a method for designing the die assembly wherein the method includes providing a die assembly including a punch, a first die shoe and a second die shoe, the die assembly used to form a workpiece into a part. Determining whether use of a die assembly generates an unbalanced forming force during operation thereof is based in part on the configuration of a nonsymmetrical part to be formed by the die assembly. Conducting an analysis of the unbalanced force including the path thereof and the stress distribution caused thereby through the die assembly including the first die shoe and the second die shoe. Providing the first die shoe, second die shoe and punch with a plurality of guide surfaces and orienting at least one of the guide surfaces of the first die shoe, second die shoe and punch at an angle with respect to a longitudinal axis and a lateral axis of the die assembly.

BRIEF DESCRIPTION OF THE DRAWINGS

FIG. 3 is a perspective view of an upper die shoe according to the embodiment.

FIG. 4 is an enlarged view of the area of circle 4 of FIG. 3.

FIG. 10 is a cross-sectional view of a punch disposed within an aperture of the first die shoe according to the embodiment.

FIG. 11 is a force diagram illustrating one example of the force distribution through the first die shoe resulting from an unbalanced load on the punch taken from circle 11 on FIG. 10.

FIG. 13 is a top view of one embodiment of a wear plate according to the embodiment.

DETAILED DESCRIPTION OF THE PREFERRED EMBODIMENTS

The following description of the embodiment(s) is merely exemplary in nature and is in no way intended to limit the embodiment, its application, or uses.

Figure 1:
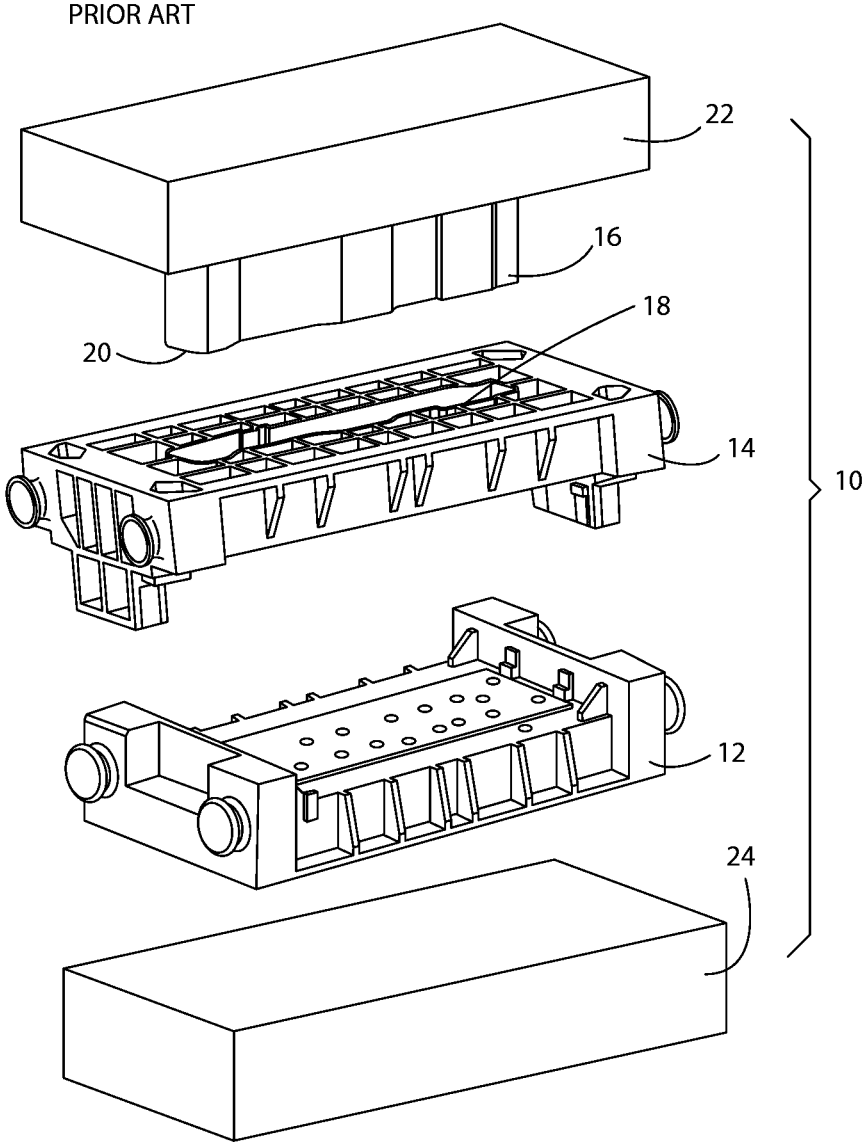
FIG. 1 PRIOR ART
FIG. 1 is a perspective view of a draw die assembly for forming a part from a workpiece according to the prior art.

FIG. 1 is a schematic illustration of a prior art toggle draw die apparatus, seen generally at 10. The draw die 10 generally includes three components, a lower die shoe 12, an upper die shoe 14 and a punch 16. The lower die shoe 12, supported on a lower bolster 24, typically includes a plurality of die retainers or blocks (not shown) containing machined impressions or cavities that cooperate with the punch 16 to shape a workpiece, typically a flat metal sheet, as the punch descends from above. The upper die shoe 14 typically functions as a binder ring. As known, the upper die shoe 14 interacts with the lower die shoe 12 to apply pressure to a workpiece located between the upper die shoe 14 and lower die shoe 12 during the forming process.

The upper die shoe 14 also includes an aperture 18 that serves as a motion guide for punch 16 travel. The punch 16 includes a forming surface 20 attached on one end thereof. Typically, the forming surface 20 on the punch 16 is complementary to the die cavity formed by the die blocks. Accordingly, the forming surface 20 of the punch 16 cooperates with the die cavity located in the lower die shoe 12 to form the sheet-metal in the shape of the desired part. The punch 16 is attached at its opposite end to an upper platen or bolster 22 of the draw die 10 that either forms part of or is correspondingly attached to a ram of a press. The draw process typically involves placing the workpiece adjacent the die cavity whereby the ram then drives the upper shoe 14 downward such that it engages or sandwiches the workpiece between the upper shoe 14 and the lower shoe 12. As the ram continues its downward stroke, the punch 16 continues downward and engages one surface of the workpiece to complete the forming process by pressing the workpiece into the shape of the die cavity. Once the forming step is complete, the punch 16 is withdrawn after which the upper die shoe 14 is lifted and the formed part can be removed from the draw die 10.

FIGS. 2-5 illustrate draw die components according to one embodiment. The components illustrated therein are shown for illustrative purposes in accordance with an exemplary embodiment of and for explaining a method of designing a die according to the embodiment. It should be understood that the components shown in these figures are illustrative of typical components used in a draw die system and that these are but one example of a draw die according to the embodiment used for the purpose of forming sheet-metal.

Figure 2:
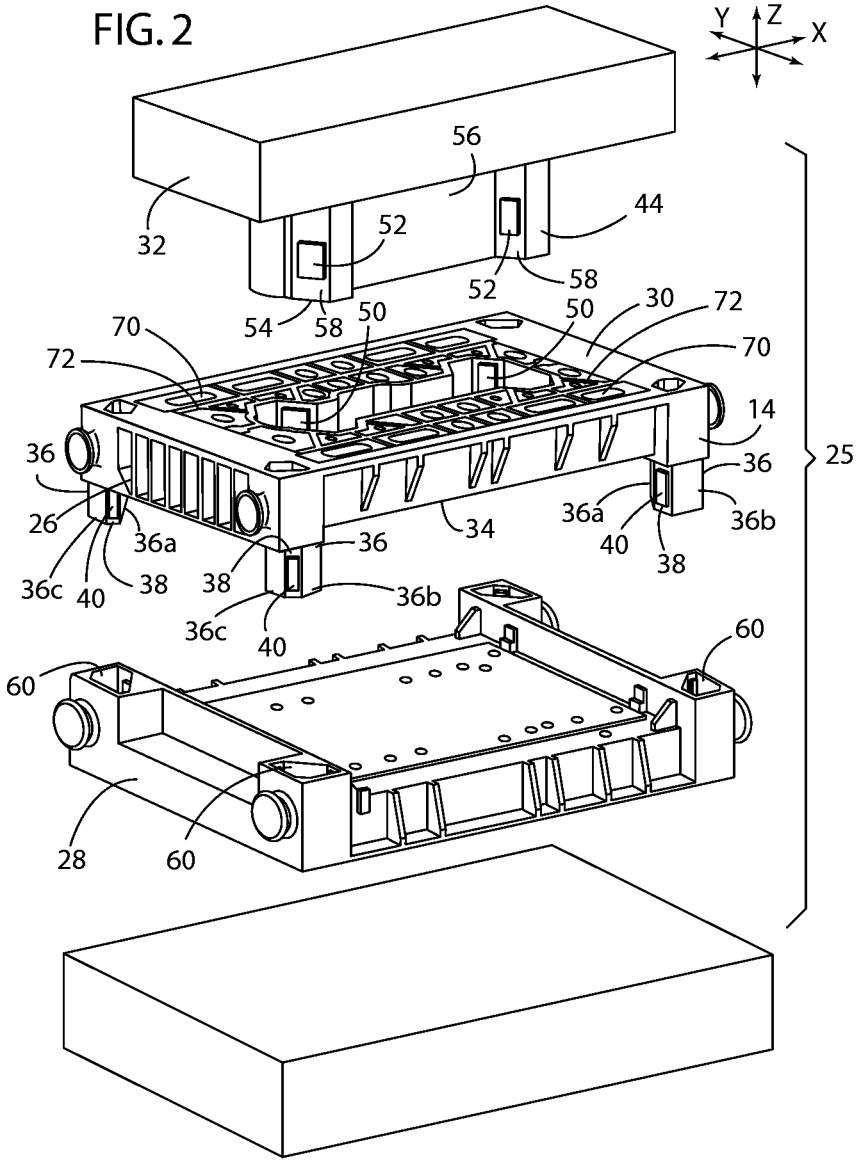
FIG. 2 is a perspective view of a draw die assembly for forming a part from a workpiece according to one aspect of the embodiment.

FIG. 2 illustrates a draw die assembly, seen generally at 25, including an upper die shoe 26 and a lower die shoe 28 forming part of the draw die assembly according to one embodiment. The upper die shoe 26 includes a top surface 30, typically driven by a platen or bolster 32 of the press, and a lower or bottom surface 34, which in the embodiment forms a blank holder used to secure the outer rim of the metal sheet as it is drawn into the die cavity. When viewed from the top surface 30, the upper die shoe 26 has a generally rectangular shape including four sides and four corners. A downwardly depending portion 36, typically termed a "heel," is located at each corner of the upper die shoe 26. As illustrated, each heel 36 has a substantially triangular shape having an inner facing surface 36*a* and two outer facing surfaces 36*b*, 36*c* with the intersections of the respective surfaces forming a chamfered vertex 38. A wear plate 40 is located at each chamfered vertex 38. The heel 36 functions to align the upper die shoe 26 and lower die shoe 28.

The upper die shoe 26 further includes an aperture or opening 42 extending through the upper die shoe 26 from the top surface 30 to the bottom surface 34. The opening 42 is shaped or configured to receive and guide the punch 44. In the embodiment, one example of the configuration of opening 42 is shown wherein the opening 42 includes two octagonal portions 46 defining guide surfaces 48. Wear plates 50 are secured to the guide surfaces 48. As shown in FIG. 10, the punch 44 also includes wear plates 52 that engage the wear plates 50 on the guide surfaces 48 to guide and properly align the punch 44 during operation.

While the punch 44 has a forming surface 54 located on an end thereof, the body 56 of the punch 44 has a correspondingly shaped octagonal portion defining a plurality of guide surfaces 58 on which the wear plates 52 are mounted. The punch 44 moves reciprocally in the aperture 42 of the upper die shoe 26 with the wear plates 52 of the punch 44 contacting the wear plates 50 of the upper die shoe 26 located in the aperture 42. The respective wear plates 50, 52 align the punch 44 with respect to the upper die shoe 26.

Figure 5:
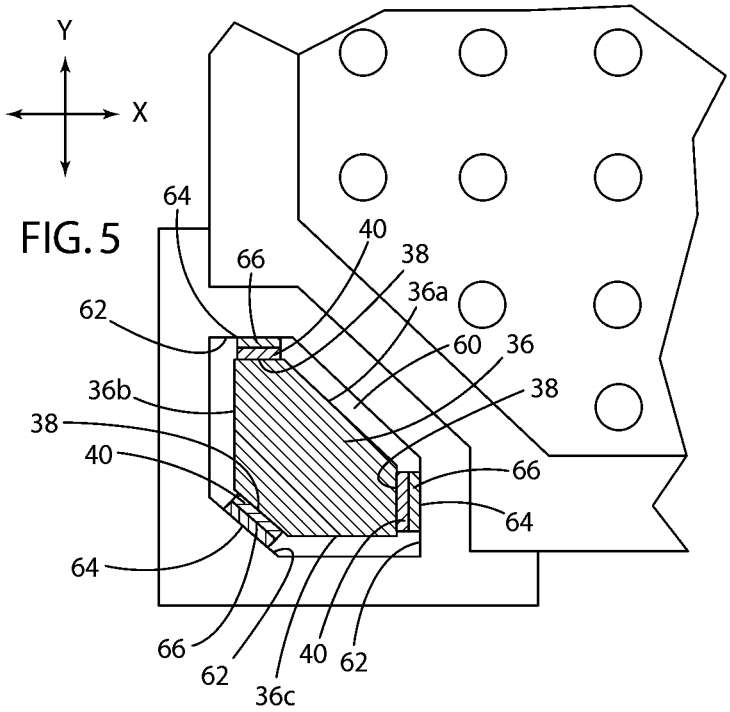
FIG. 5 is a cross-sectional view illustrating the heel of the first die shoe disposed in the socket of the second die shoe according to the embodiment.

As illustrated in FIG. 2 the lower die shoe 28 also has a generally rectangular shape including four sides and four corners. Substantially triangular shaped sockets 60 are located at each of the respective corners of the lower die shoe 28. As illustrated in FIG. 5, each socket 60 has an engagement or guide surface 62 located at each vertex 64. A wear plate 66 is located on the engagement surface 62. Accordingly, the sockets 60 have a complementary shape to that of the heels 36 wherein the respective wear plates 40, 66 are positioned adjacent and contact one another as the heel 36 moves reciprocally in the socket 60.

Figure 6:
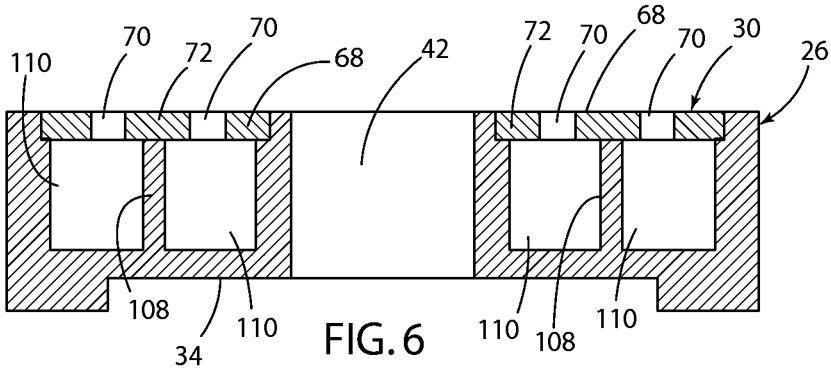
FIG. 6 is a cross-sectional view taken along lines 6-6 of FIG. 3.

FIGS. 2 & 6 illustrate another aspect of the embodiment wherein the upper die shoe 26 includes a plate member 68 forming the top surface 30 of the upper shoe 26. The plate member 68 functions to reduce torsional loads occurring in the upper die shoe 26 during the workpiece forming process. The embodiment contemplates attaching the plate member 68 to the top of an existing die shoe using a welding or other joining method. In addition, the upper die shoe 26 can be made using a casting method or process such as a lost core method or technique. As illustrated, the plate member 68 may contain a plurality of apertures 70 and stiffening ribs 72 configured to decrease weight and increase the resistance any torsional loading occurring during the forming process.

FIG. 5 illustrates one of the heels 36 of the upper die shoe 26 located in one of the sockets 60 of the lower die shoe 28. The wear plates 40 of the heel 36 contacting the wear plates 66 of the socket 60 to align the upper die shoe 26 with the lower die shoe 28.

Figure 7:
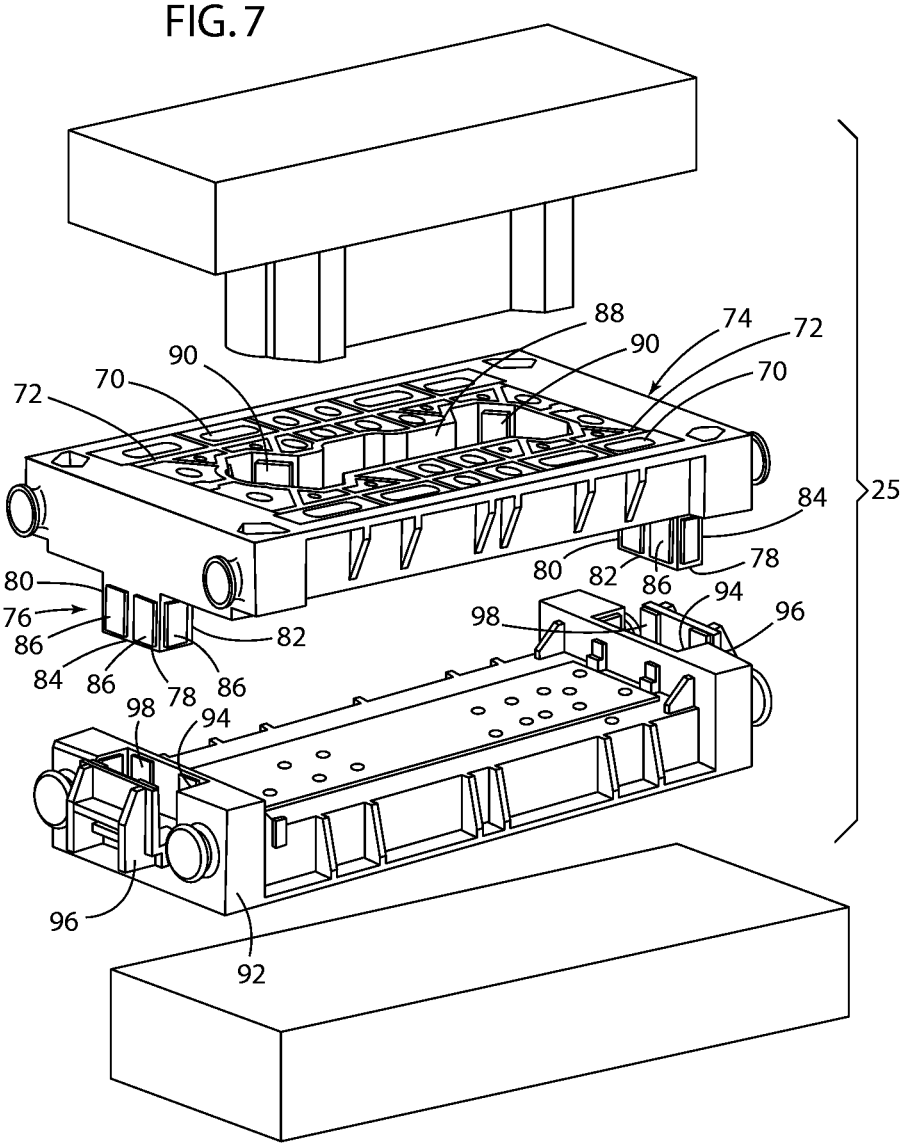
FIG. 7 is a perspective view of an alternative embodiment of a draw die assembly for forming a part from a workpiece according to one aspect of the embodiment.
Figure 8:
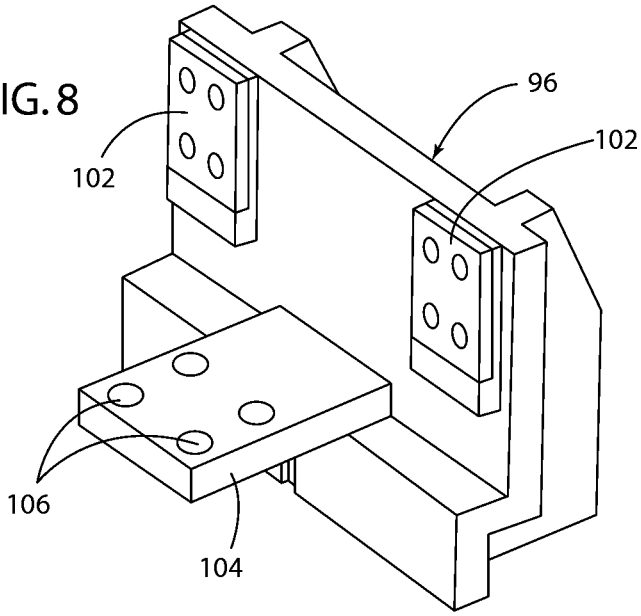
FIG. 8 is a perspective view of a bracket for use with the alternative embodiment of the draw die assembly illustrated in FIG. 7.
Figure 9:
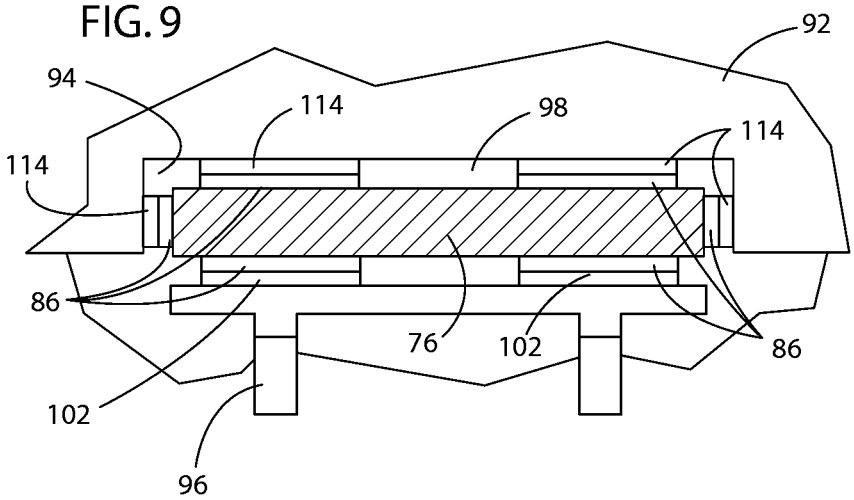
FIG. 9 is a cross-sectional view illustrating the heel of the first die shoe disposed in the socket of the second die shoe according to the alternative embodiment illustrated in FIG. 7.

FIGS. 7-9 illustrate an alternative embodiment with like parts having like reference members wherein the upper die shoe 74 has first and second downwardly depending heels 76 located at each end or side thereof instead of at the corners as disclosed in the previous embodiment. In other aspects, the upper die shoe 74 is similar to the upper die shoe 26 of the previous embodiment. As illustrated, the heel 76 of the upper die shoe 74 has front 78, rear 80 and opposing inner 82 and outer 84 side surfaces forming a substantially rectangular shape. The heel 76 further includes wear plates 86 located on the respective front 74, rear 78, inner side 82 and outer side 84 surfaces. Depending upon the length of the respective inner side 82 and outer side 84 surfaces, multiple wear plates 86 are placed thereon. As with the previous embodiment, the upper die shoe 74 includes an aperture 88 through which the punch travels in a reciprocal motion during the forming process and wherein wear plates 90 are placed in the aperture and engage corresponding wear plates located on the punch.

As illustrated, the lower die shoe 92 includes a channel 94 and bracket 96 combining to form a socket 98 sized to receive the heel 76 of the upper die shoe 74. The channel 94 including a plurality of wear plates 114 located on the side surfaces thereof. The bracket 96 is illustrated, see FIG. 8, as a separate, stand-alone member with a support face 100 having wear plates 102 attached thereto. The bracket 96 further includes an attachment member 104 having a plurality of apertures 106 used to secure the bracket 96 to the lower die shoe 92. The embodiment contemplates forming the bracket 96 integral with the lower die shoe 92; however, forming the bracket 96 by itself and attaching it as a separate member to the lower die shoe 92 enables both adjustment and flexibility when constructing a new or modifying an existing lower die shoe 92. Accordingly, such a design may be used to retrofit or redesign existing die shoes by adding a bracket 96 thereto forming a socket 98 for constraining the heel 76 of an opposing die shoe.

FIG. 9 shows the heel 76 of the upper die shoe 74 located in the socket 98 of the lower die shoe 92 formed by the bracket 96 and the channel 94 of the lower die shoe 92. Accordingly, the socket 98 functions to constrain the heel 76 of the upper die shoe 74 and align the upper die shoe 74 with the lower die shoe 92.

As disclosed, both embodiments are constructed such that the interior region or area of the respective upper die shoe 26,74 has a honeycomb type construction, see FIG. 6, including strengthening ribs 108 and chambers 110 that function to maintain rigidity and strength while reducing the overall weight of the die shoe. Adding the plate member 68 helps control stress and correspondingly deflection and distortion of the die shoe 26 in the lateral direction, that is in x-y axis or the plane of the plate member 68 wherein the Z-axis represents the direction of reciprocal motion of the die or press travel, see FIG. 2. In addition, as set forth below, the configuration of both the plate member 68 and the honeycomb type construction of the upper die shoe 26; i.e., the placement of the various ribs and openings can be determined based upon loading conditions including unbalanced system loads, occurring during the forming process.

For example, during the stamping cycle or forming process the ram of the press generally generates a forming force in the vertical or Z-axis. Even though the press generates a force in the Z-axis, the die assembly may be subjected to an unbalanced forming force, which can be significant when the part is non-symmetrical. Generally, an unbalanced stamping force is present in both the blank feeding and transverse directions (y and x direction) when a stamped workpiece has unsymmetrical geometry. Accordingly, a very basic non-symmetrical shape will create an unbalanced forming force causing a lateral load or force that causes the punch 44 to deviate from its vertical position and interact with the upper die shoe 26. That is the unbalanced forming force causes the punch 44 to shift or move in the X-axis, the Y-axis or a combination of both and correspondingly act on the upper die shoe 26.

Generally speaking, the unbalanced force is present in both blank feeding and transverse directions, that is in both the y and x directions, when the workpiece has a non-symmetrical geometry. Accordingly, changing the die blocks and correspondingly the shape of the die cavity located in the lower die shoe 28 subjects the die to different loading conditions and correspondingly different deflection and distortion tendencies. Accordingly, in some cases the unbalanced load may cause distortion in the direction of or along the Y-axis while a different unbalanced force may cause distortion in the direction of or along the X-axis or it may be a combination of both.

The wear plates 50 on the upper die shoe 26 and the wear plates 52 on the punch 44 are the media for lateral force or load transfer between the respective punch 44 and upper die shoe 26. The lateral force exerted by the punch 44 causes distortion and deflection of the upper die shoe 26, which can correspondingly cause distortion and deflection of the lower die shoe 28 as the force is transferred through the upper die shoe 26 to the lower die shoe 28. The unbalanced forming force creates an interaction between the upper die shoe 26 and lower die shoe 28 through the wear plates 40, 66 located on the respective heel of the upper die shoe 26 and the socket of the lower die shoe 28. The wear plates 40, 66 are the media for lateral force or load transfer between the upper die shoe 26 and the lower die shoe 28 secured to the press base. Should the unbalanced force occur in the x-direction the upper die shoe 26 would attempt to move laterally in the x-direction wherein such movement would be constrained by the heels 36 located in the respective sockets 60. Thus the load generated by the unbalanced force would be transferred to the lower die shoe 28. Reconfiguring the heel 36 and sockets 60 according to the embodiment redistributes the unbalanced load or force over a greater portion of the upper die shoe 26 thus reducing the stress in any one section or area thereof and reducing the possibility for failure at the point of increased stress.

The position of the wear plates 50, 52 between the punch 44 and the upper die shoe 26 as illustrated in FIGS. 10-11 is one embodiment of a method for transferring lateral forces exerted on the upper die shoe 26 by the punch 44 during the forming process. As illustrated, the wear plates 50, 52 are placed at an angle with respect to the X and Y axis, with the angle being approximately 45°. Accordingly, should a lateral force occur in the direction of the X-axis, for example a force is applied in the direction of the arrow 100 or in a direction toward the left side of the upper shoe 26, that force is then transferred to the respective wear plates 50*a*, 50*b*, 50*c*, 50*d* located on the left side of each of the apertures 42. Using one of the wear plates 50*a* as an example, the force (f) is applied perpendicular to the respective wear plate 50*a* and has components AX and AY. Thus, the force (f) applied by the punch 44 through the respective wear plates 52*a*, 52*b*, 52*c*, 52*d* on the punch 44 to the wear plates 50 and correspondingly the upper die shoe 26 can be viewed as or broken down into two separate components, with the magnitude of each component AX and AY depending upon the direction of the force (f) and the angle of the wear plate 50 with respect to the X and Y-axis. Accordingly, varying the angle of the wear plate 50 with respect to the X and Y-axis changes or varies the load distribution and, depending upon the load and direction thereof, distributes the load over a greater portion of the upper die shoe 26 thus reducing potential deflection and distortion thereof As further illustrated in FIG. 11, the upper die shoe 26 includes a plurality of apertures 42 with each of the apertures having wear plates 50 wherein the unbalanced force or lateral load generated by the punch 44 is distributed over a greater portion of the upper die shoe 26 through the wear plates 50 of both the first and second apertures 42. While the apertures 42 are shown having an octagonal shape and the wear plates 50 are shown located on the side surfaces thereof at a 45° angle with respect to the X and Y-axis, depending upon the particular die design and the anticipated direction and magnitude of any unbalanced force generated during the stamping process, the configuration of the apertures 42 and corresponding position of the wear plates 50 can be arranged to receive and distribute the unbalanced force thereby controlling deflection and distortion of the upper die shoe. Accordingly, using multiple wear plates 50 shifts the load to multiple locations or regions.

Figure 12:
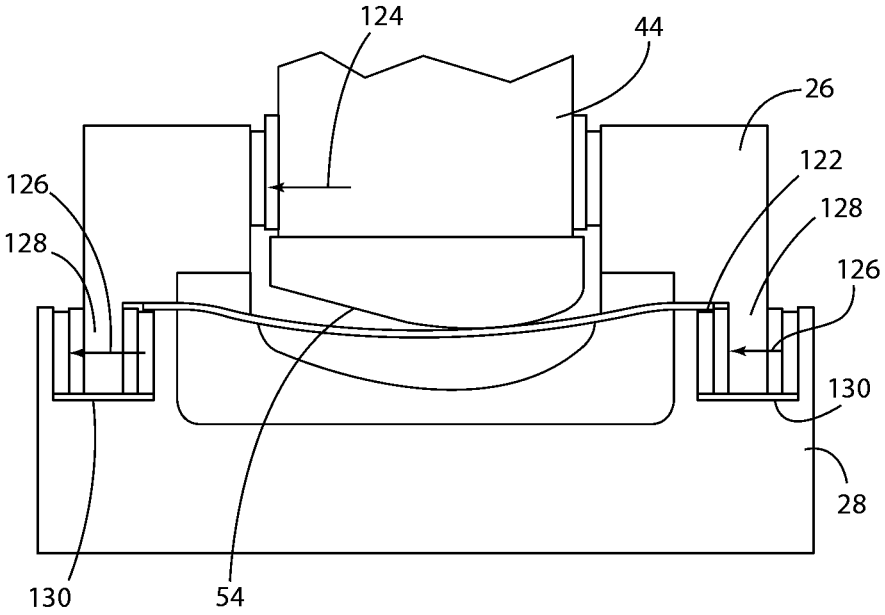
FIG. 12 is a schematic illustration of a draw die assembly according to the embodiment diagramming the unbalanced force.

Accordingly, a force causing the upper die shoe to shift laterally in the X-direction is countered on both sides of the draw die assembly 25 by the heel and socket, located on the respective upper and lower die shoes. For example, FIG. 12 schematically illustrates the forces occurring in the draw die assembly 25 when the forming surface 54 of the punch 44 contacts and forms the workpiece 122 sandwiched between the upper die shoe 26 and the lower die shoe 28. Upon contacting the workpiece 122, the nonsymmetrical shape of the forming surface 54 causes punch 44 to shift left, whereby the punch 44 engages the upper die shoe 26 and exerts a force in the direction of the arrow 124 on the upper die shoe 26. Consequently, the upper die shoe 26 thereby generates a force in the direction of the arrows 126 on the lower die shoe 28. Since the respective heels 128 are captured in the sockets 130 located on the lower die shoe 28, the heels 128 to distribute the force in the direction of the arrow 124 over a greater area of both the upper die shoe 26 and the lower die shoe 28.

As pointed out previously, orientating the respective wear plates 40, 66 at an angle also aids in distributing the unbalanced force generated during the forming operation over a greater portion of the respective upper and lower die shoes 26, 28 thereby reducing potential deflection and distortion. Thus, by capturing the heel 36, i.e. surrounding the heel 36 in the aperture or socket 60, the unbalanced load is transferred or distributed over a greater area of the respective draw die assembly 25. Thus, all four of the heels 36 of the upper die shoe 26 act or cooperate together to distribute any unbalanced forming forces over a greater portion of the respective die shoe.

Distributing the unbalanced loads over a greater area of the respective die components reduces the stress at various portions of the die and correspondingly reduces die failure. As with the punch 44 and upper die shoe 26 interface, depending upon the anticipated loading forces and direction thereof exerted during die operation, the position of the wear plates 40, 66 and shape of the respective heels 36 and sockets 60 can be designed to distribute stresses and corresponding deflection and distortion thereby creating a robust die design.

While the heel 36 is shown positioned on the upper die shoe 26, the embodiment contemplates placing the heel 36 on the lower die shoe 28 or if desired a combination of heels 36 and corresponding sockets 60 located on both of the upper and lower die shoes 26, 28. In addition, since many manufacturing dies are used to make a variant of a current component; e.g. a newer component may vary only slightly from its former shape, actual load readings may be taken based upon gauges located in the dies. Thus, for a die currently in use, new or additional wear plates can be installed at various positions and angles to further direct or control the stress in the die components resulting from the unbalanced forming force. For example, while the wear plates are typically blocks having a rectangular cross section see FIG. 11, as illustrated in FIG. 13 a wear plate 116, having an angled cross section; that is one with non-parallel sides could replace the wear plates of an existing die system. Thus, the contact face 118 of the wear plate 116 would be skewed with respect to the mounting face 120 and depending upon its particular orientation could be used to control the load path. Thus, changing the orientation of the contact face 118 of the wear plate 116 with respect to the X and Y-axis of the die system is one method and mechanism for tuning the die system. Such a method could be used for additional tuning of existing die systems.

The embodiment further includes a method for designing a die such as a system rather than a stack-up of individual dies. As set forth previously, within a die system the external loads ultimately come from both the stamping press and the die set. These unbalanced forming forces are unavoidable when the dies are used as tools to form sheet-metal into a part. The embodiment contemplates designing or determining the unbalanced load path and distribution of the associated stress in the die system to optimize the die design, that is the stress and corresponding distortion and deflection are distributed to minimize localized stress in the respective die components. Accordingly, the interface between the punch 44 and upper die shoe 26 along with the interface between the upper and lower die shoes 26, 28 each play a critical role in the die system function and performance. As set forth above, the heels 36 located on the upper die shoe 26 interact with sockets 60 on the lower die shoe 28 to align the upper and lower die shoes 26, 28.

Given that the basic relationships between the structural load path and the various components of the die system are known, the methodology set forth herein enables the manufacture of a specific die design, shape or configuration wherein the stamping force is transferred and distributed through the die system in a more even manner to reduce localized stress concentration and reduce the possibility for die failure. As illustrated previously the upper die shoe 42 may differ from the punch opening, the shape or outline of the surface of the punch; wherein the method enables creation of a die design that reduces localized stress created by a load exerted only on a portion of the die structure. Specifically, using wear plates placed at predetermined positions and locations to redirect unbalanced loads occurring during the stamping provides a mechanism to balance and distribute loads and effectively improve stress distribution.

Accordingly, one method of designing a die system according to the embodiment involves determining wear plate geometry and location for both the punch 44 and upper die shoe 26 and upper die shoe 26 and lower die shoe 28 interfaces. As known during the stamping operation, there must be equilibrium of forces thus, any forces generated by the punch during a stamping operation or process in either the x or y axis generates an unbalanced force that travels through the respective die components to the base of the press assembly.

The unbalanced forming force and its direction are based in large part on the configuration or design of the part. Using the configuration of the part as a starting point, the first step is conducting an analysis of the unbalanced stamping force and the path through the upper die shoe 26 and lower die shoe 28 along with other die components. Based on the unbalanced load conditions, a finite element analysis is one method used to determine the interface design; that is, the geometry and location of the wear plates 50 on the upper die shoe 26 to reduce localized stress and the potential for die failure.

Thus, the method according to the embodiment involves first reviewing the non-symmetrical part to determine the unbalanced forming force wherein the unbalanced forming force is the force that causes the punch 44 to deviate from its vertical position. After determining the unbalanced forming force, the next step is initially aligning the wear plates 50, 40 to distribute the load. Depending upon the direction of the unbalanced forming force, one embodiment contemplates placing the wear plates at a 45° angle with respect to the X and Y-axis as starting point. Thus, both the wear plates 52, 50 positioned between the punch 44 and upper die shoe 26 and the wear plates 40, 66 placed between the upper die shoe 26 and lower die shoe 28 are placed at a 45° angle with respect to the X and Y-axis. After the wear plates are initially located, the next step is determining the load distribution in the upper and lower die shoes 26, 28. Specifically, the punch/upper die shoe interface is analyzed along with the upper die shoe/lower die shoe interface. This step can be accomplished using a finite element analysis based on approximated loads occurring in the x and y direction that reflect the unbalanced stamping force in the x and y direction. Once the analysis is completed, details regarding the contours of the distributions of the maximum principal stress and minimum principal stress provide information about the stress state of the components in terms of tension or compression. Based on the analysis additional support can be built into the respective die members, additional wear plates can be inserted or the angle thereof can be changed, all of which providing options to control the distortion in various areas or locations of the die components.

Thus, the embodiment provides a method and mechanism to distribute unbalanced forming loads occurring during the stamping process rather than simply increasing the size of structural walls and ribs of the die. As set forth above while increasing the size of the die components may reduce die failure, it also increases the cost and weight thereof and ultimately is not the answer. Accordingly, the embodiment provides a method for improving die structure performance by optimizing the structure and configuration of the die, including the configuration of the heel 36 on the upper die shoe 26 and corresponding socket 60 on the lower die shoe 28. Thus, depending upon the critical areas as defined by stress distribution, including the maximum principal and minimum principal stress, maximum distortion including maximum stretching and maximum compression, the upper die shoe 26 and lower die shoe 28 can be configured accordingly to distribute the stress caused by unbalance forming loads thereby reducing potential for die failure.

Accordingly, the embodiment provides a fundamentally new die and method for die design including a structural pattern component interface and motion constraint, which changes these stresses and deformations of the die system to improve die performance.

The description of the embodiment is merely exemplary in nature and, thus, variations that do not depart from the gist of the embodiment are intended to be within the scope of the embodiment. Such variations are not to be regarded as a departure from the spirit and scope of the embodiment.

What is claimed is:

1. A die assembly for use in forming a workpiece comprising:

a first die shoe and a second die shoe said first die shoe and said second die shoe operative to move between a first, open position and a second, closed position;

said first die shoe having an aperture and at least one heel; and said second die shoe having at least one socket wherein when said first die shoe and said second die shoe are placed in said second, closed position said heel of said first die shoe is located in said socket of said second die shoe;

said first die shoe having a top member and a bottom member, said top member and said bottom member spaced apart and joined by a front wall and a rear wall and a left sidewall and a right sidewall wherein said first die shoe has a generally rectangular shape having a longitudinal, a lateral and a transverse axis;

said aperture of said first die shoe extending through said first die shoe in said transverse direction from said top member to said bottom member;

an interior wall extending between said top member and said bottom member and forming a boundary of said aperture and said interior wall having at least one guide surface;

a punch, said punch having a longitudinal axis and a body extending generally in the direction of the longitudinal axis, said body having at least one guide surface wherein when said punch is disposed within said aperture of said first die shoe, said at least one guide surface of said punch engages said at least one guide surface of said first die shoe; and said at least one guide surface of said first die shoe skewed with respect to said longitudinal and a lateral axis of said first die shoe.

2. A die assembly for use in forming a workpiece as set forth in claim 1 including:

a plurality of heels located on said first die shoe wherein a heel is located at each corner of said first die shoe, each of said heels having a plurality of guide surfaces; and said second die shoe having a plurality of sockets having a plurality of guide surfaces, each of said sockets located such that each heel is disposed within a corresponding socket and the guide surfaces of each heel are adjacent the guide surfaces each socket when said first die shoe and said second die shoe are placed in said second, closed position.

3. A die assembly for use in forming a workpiece comprising:

a first die shoe and a second die shoe said first die shoe and said second die shoe operative to move between a first, open position and a second, closed position;

said first die shoe having an aperture and at least one heel; and said second die shoe having at least one socket wherein when said first die shoe and said second die shoe are placed in said second, closed position said heel of said first die shoe is located in said socket of said second die shoe;

said first die shoe having a top member and a bottom member, said top member and said bottom member spaced apart and joined by a front wall and a rear wall and a left sidewall and a right sidewall wherein said first die shoe has a generally rectangular shape having a longitudinal, a lateral and a transverse axis;

said aperture of said first die shoe extending through said first die shoe in said transverse direction from said top member to said bottom member;

an interior wall extending between said top member and said bottom member and forming a boundary of said aperture and said interior wall having at least one guide surface;

a punch, said punch having a longitudinal axis and a body extending generally in the direction of the longitudinal axis, said body having at least one guide surface wherein when said punch is disposed within said aperture of said first die shoe, said at least one guide surface of said punch engages said at least one guide surface of said first die shoe;

said at least one guide surface of said first die shoe skewed with respect to said longitudinal and a lateral axis of said first die shoe;

a plurality of heels located on said first die shoe wherein a heel is located at each corner of said first die shoe, each of said heels having a plurality of guide surfaces;

said second die shoe having a plurality of sockets having a plurality of guide surfaces, each of said sockets located such that each heel is disposed within a corresponding socket and the guide surfaces of each heel are adjacent the guide surfaces each socket when said first die shoe and said second die shoe are placed in said second, closed position; and said heels have a triangular shaped cross section including three outer surfaces and a guide surface generally located at each vertex of adjoining outer surfaces wherein at least one of said guide surfaces is orientated such that it is located in a plane skewed with respect to said longitudinal and lateral axis of said first die shoe.

4. A die assembly for use in forming a workpiece comprising:

a first die shoe and a second die shoe said first die shoe and said second die shoe operative to move between a first, open position and a second, closed position;

said first die shoe having an aperture and at least one heel;

said second die shoe having at least one socket wherein when said first die shoe and said second die shoe are placed in said second, closed position said heel of said first die shoe is located in and surrounded by said socket of said second die shoe;

said first die shoe having a top member and a bottom member, said top member and said bottom member spaced apart and joined by a front wall and a rear wall and a left sidewall and a right sidewall wherein said first die shoe has a generally rectangular shape with a plurality of corners and having a longitudinal, a lateral and a transverse axis;

a plurality of heels located on said first die shoe wherein a heel is located at each corner of said first die shoe, each of said heels having a plurality of guide surfaces;

said second die shoe having a plurality of sockets having a plurality of guide surfaces, each of said sockets located such that each heel is disposed within a corresponding socket and the guide surfaces of each heel are adjacent the guide surfaces each socket when said first die shoe and said second die shoe are placed in said second, closed position;

said heels have a triangular shaped cross section including three outer surfaces and a guide surface generally located at each vertex of adjoining outer surfaces wherein at least one of said guide surfaces is orientated such that it is located in a plane skewed with respect to said longitudinal and lateral axis of said first die shoe; and a wear plate attached to said guide surface.

5. A die assembly for use in forming a workpiece comprising:

a first die shoe and a second die shoe said first die shoe and said second die shoe operative to move between a first, open position and a second, closed position;

said first die shoe having an aperture and at least one heel;

said second die shoe having at least one socket wherein when said first die shoe and said second die shoe are placed in said second, closed position said heel of said first die shoe is located in and surrounded by said socket of said second die shoe, said first die shoe having a top member and a bottom member, said top member and said bottom member spaced apart and joined by a front wall and a rear wall and a left sidewall and a right sidewall wherein said first die shoe has a generally rectangular shape having a longitudinal, a lateral and a transverse axis;

first heel located on said first die shoe adjacent said left sidewall and a second heel located on said first die shoe adjacent said right sidewall, said first and second heels having a front surface, a rear surface, and inner surface, and an outer surface wherein said first and second heels have a generally rectangular cross-section; and a wear plate located on said front surface, said rear surface, said inner surface and said outer surface of each of said first and second heels;

said second die shoe includes first and second sockets located thereon, said second die shoe includes first and second channels located on first and second sides of said second die shoe; and first and second brackets each of said first and second brackets having a support face, said first and second brackets connected to said second die shoe adjacent said first and second channels whereby said support face of said first and second brackets cooperates with an inner surface of said first and second channels to form said first and second sockets; and said inner surface of said first and second channels and said support face of said first and second brackets contain wear plates wherein said wear plates are positioned adjacent said wear plates of said first and second heels when said first die shoe and said second die shoe are placed in said second, closed position.

6. A die assembly for use in forming a workpiece comprising:

a first die shoe and a second die shoe said first die shoe and said second die shoe operative to move between a first, open position and a second, closed position;

said first die shoe having an aperture and at least one heel;

said second die shoe having at least one socket wherein when said first die shoe and said second die shoe are placed in said second, closed position said heel of said first die shoe is located in said socket of said second die shoe;

said first die shoe having a top member and a bottom member, said top member and said bottom member spaced apart and joined by a front wall and a rear wall and a left sidewall and a right sidewall wherein said first die shoe has a generally rectangular shape having a longitudinal, a lateral and a transverse axis;

said aperture of said first die shoe extending through said first die shoe in said transverse direction from said top member to said bottom member;

an interior wall extending between said top member and said bottom member and forming a boundary of said aperture and said interior wall having at least one guide surface;

a punch, said punch having a longitudinal axis and a body extending generally in the direction of the longitudinal axis, said body having at least one guide surface wherein when said punch is disposed within said aperture of said first die shoe, said at least one guide surface of said punch engages said at least one guide surface of said first die shoe;

said at least one guide surface of said first die shoe skewed with respect to said longitudinal and a lateral axis of said first die shoe;

said body of said punch has at least one portion having an octagonal cross section said octagonal cross section having at least four guide surfaces; and said aperture in said first die shoe having at least one portion there of having a octagonal cross section with at least four guide surfaces wherein said guide surfaces of said punch and the guide surfaces of said first die shoe are positioned such that when the punch is positioned in the aperture, the respective guide surfaces are skewed with respect to the longitudinal and lateral axis of the first die shoe.

7. A die assembly for use in forming a workpiece as set forth in claim 1 including:

said top member and said bottom member of said first die shoe defining an interior cavity; and a plurality of ribs extending between said top and bottom members of said first die shoe such that said interior cavity has a honeycomb structure.

* * * * *